US009828169B2

(12) United States Patent
Karekar

(10) Patent No.: US 9,828,169 B2
(45) Date of Patent: Nov. 28, 2017

(54) AEROSOL VENTING METHOD

(71) Applicant: Conopco, Inc., Englewood Cliffs, NJ (US)

(72) Inventor: Shyamsunder Balakrishna Karekar, Mangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/108,648

(22) PCT Filed: Dec. 23, 2014

(86) PCT No.: PCT/EP2014/079248
§ 371 (c)(1),
(2) Date: Jun. 28, 2016

(87) PCT Pub. No.: WO2015/104188
PCT Pub. Date: Jul. 16, 2015

(65) Prior Publication Data

US 2016/0325918 A1 Nov. 10, 2016

(30) Foreign Application Priority Data

Jan. 7, 2014 (EP) ..... 14150353

(51) Int. Cl.
*B65D 83/70* (2006.01)
*B65D 83/48* (2006.01)
(Continued)

(52) U.S. Cl.
CPC ..... *B65D 83/70* (2013.01); *B65D 83/44* (2013.01); *B65D 83/48* (2013.01); *B65D 83/663* (2013.01)

(58) Field of Classification Search
CPC ..... B65D 83/70; B65D 83/44; B65D 83/663; B65D 83/48
See application file for complete search history.

(56) References Cited

U.S. PATENT DOCUMENTS 5,114,043 A 5/1992 Collins, Jr.
5,309,956 A 5/1994 Hajma
2010/0019000 A1* 1/2010 Kraus ..... B65D 83/70 222/397

FOREIGN PATENT DOCUMENTS

JP 48008725 3/1973
JP 1139863 9/1989
(Continued)

OTHER PUBLICATIONS

Search Report and Written Opinion in EP14150353 dated Jun. 18, 2014. pp. 1 to 4.
(Continued)

*Primary Examiner* — Donnell Long
(74) *Attorney, Agent, or Firm* — Karen E. Klumas

(57) ABSTRACT

A method for releasing residual pressurized fluid from an aerosol canister, said method comprising the manual opening of a vent assembly (614) for said canister (600), the vent assembly (614) comprising first (615) and second (616) members and a receiving part (617), the receiving part (617) having an outer surface configured to form a fluid seal against an edge of a hole in the canister (600), and an internal volume having a longitudinal axis, the second member (616) disposed within the internal volume of the receiving part (617) and configured for linear translation along the longitudinal axis relative to the receiving part (617), the first member (615) rotatably engaged with the second member (616), rotation of the first member (615) relative to the second member (616) configured to impart translation of the second member (616) along the longitudinal axis such that, in a first position, the second member (616) forms a fluid seal against the receiving part (617) and,
(Continued)

in a second position, a fluid passage is formed between the second member (616) and an inner surface of the receiving part (617).

10 Claims, 5 Drawing Sheets

(51) Int. Cl.
*B65D 83/44* (2006.01)
*B65D 83/66* (2006.01)

(56) References Cited

FOREIGN PATENT DOCUMENTS

| | | |
|---|---|---|
| JP | 0491887 | 8/1992 |
| JP | 10305878 | 11/1998 |
| JP | 2005263285 | 9/2005 |
| WO | WO2007145065 | 12/2007 |

OTHER PUBLICATIONS

Search Report and Written Opinion in PCTEP2014079248 dated Mar. 18, 2015. pp. 5 to 13.

* cited by examiner

AEROSOL VENTING METHOD

TECHNICAL FIELD

The present disclosure relates to the field of pressurised canisters, associated methods and apparatus, and in particular concerns a method for manually venting a pressurised canister.

BACKGROUND

Aerosol canisters are currently used to dispense a large range of products, from deodorants to insecticides and paints. Aerosol canisters sometimes need to be disposed of before they are completely empty. This occurs for a variety of reasons, for example when the spray mechanism no longer operates as intended, when the propellant is used up before the product is finished, or when the product is no longer required or wanted.

There are, however, several features of aerosol canisters that complicate their disposal. Firstly, many aerosol canisters contain propellants that may be flammable or environmentally harmful. Secondly, aerosols canisters are pressurised. If punctured, the contents of the canister can be released so forcefully that injuries may result. Also, extreme temperatures may cause canisters to rupture, and moisture may cause them to rust, thereby resulting in the release of their contents. As many aerosol canisters contain hazardous fluids, this poses both environmental and health concerns.

Japan has passed regulations which require consumers to ensure that all aerosol canisters above 100 g are evacuated of fluid before disposal into the public waste system. Complying with such regulations is therefore an important issue.

Many Japanese suppliers have opted to use the actuator and cap of the canister to achieve compliance. As described in WO2007/145065, for example, the cap may be used to maintain the actuator in the depressed position to release the fluid. A problem associated with this approach, however, is that it restricts the design of the actuator. Other methods, as for example described in U.S. Pat. No. 5,114,043 and U.S. Pat. No. 5,309,956, involve controlled puncturing of the canister to release the pressurised fluid, but these require the use of heavy duty equipment to secure the canister in place and withstand the force of the fluid during evacuation.

The methods disclosed herein seek to address one or more of these issues.

The listing or discussion of a prior-published document or any background in this specification should not necessarily be taken as an acknowledgement that the document or background is part of the state of the art or is common general knowledge. One or more aspects/embodiments of the present disclosure may or may not address one or more of the background issues.

SUMMARY

According to a first aspect, there is provided a method for releasing residual pressurised fluid from an aerosol canister, said method comprising the manual opening of a vent assembly for said canister, the vent assembly comprising first and second members and a receiving part, the receiving part having an outer surface configured to form a fluid seal against an edge of a hole in the canister, and an internal volume having a longitudinal axis, the second member disposed within the internal volume of the receiving part and configured for linear translation along the longitudinal axis relative to the receiving part, the first member rotatably engaged with the second member, rotation of the first member relative to the second member configured to impart translation of the second member along the longitudinal axis such that, in a first position, the second member forms a fluid seal against the receiving part and, in a second position, a fluid passage is formed between the second member and an inner surface of the receiving part.

An advantage of the invention is that the canister can be vented easily by a positive action of rotating the first member relative to the second member. This action also allows for ease of inspection that the canister has been properly vented, because rotation of the first member provides a clear indication that venting has occurred.

The first and second members may be rotatably engaged by a cam mechanism. The cam mechanism may comprise a helical slot and a corresponding cam. The first member may comprise the helical slot and the second member may comprise the corresponding cam. Alternatively, the second member may comprise the helical slot and the first member may comprise the corresponding cam.

The second member may comprise a gasket. The gasket may be configured to provide a fluid-tight seal between the second member and the receiving part when the second member is in the first position.

The receiving part may comprise an opening. The opening may be configured to allow the fluid to pass from the fluid passage to the outside of the canister in a direction substantially perpendicular to the longitudinal axis.

Providing a passage that directs fluid from the canister in a direction perpendicular (or orthogonal) to the longitudinal axis ensures that the fluid is directed away from fingers of the user operating the vent assembly.

The first member may comprise a handle to facilitate rotation of the first member by a user. The handle may be connected to the first member by a hinged connector. The handle may be configured such that rotation of the handle about the hinged connector allows the handle to be moved from a first position to a second hinged position. The handle may be located further from the fluid as the fluid passes through the opening when the handle is in the second position relative to the first position.

Using a handle as part of the first member has the advantage that a user can more easily grasp and rotate the first member. Using a hinged handle has two advantages, a first being that of allowing a user to more easily grasp the handle, which may be provided in a recess in the base of the canister, and a second being that of providing a clear indication that the canister has been vented once the handle has been hinged downwards and rotated.

The canister may comprise a protruding element. The protruding element may be configured to engage with the handle when the handle is in the first position. Engagement of the protruding element with the handle may be configured to prevent rotation of the first element.

The use of a protruding element has the advantage of preventing accidental operation of the vent assembly.

The vent assembly may comprise a removable seal. The removable seal may be attached to the handle and the first member. The removable seal may be configured to prevent rotation of the handle from the first position to the second position.

A removable seal has the advantage of both providing a positive indication that venting has occurred and of preventing accidental operation of the vent assembly.

According to a further aspect, there is provided a canister comprising any vent assembly described herein.

The present disclosure includes one or more corresponding aspects, embodiments or features in isolation or in various combinations whether or not specifically stated (including claimed) in that combination or in isolation. Corresponding means for performing one or more of the discussed functions are also within the present disclosure.

The above summary is intended to be merely exemplary and non-limiting.

BRIEF DESCRIPTION OF THE FIGURES

A description is now given, by way of example only, with reference to the accompanying drawings, in which.

DESCRIPTION OF SPECIFIC ASPECTS/EMBODIMENTS

Figure 1:
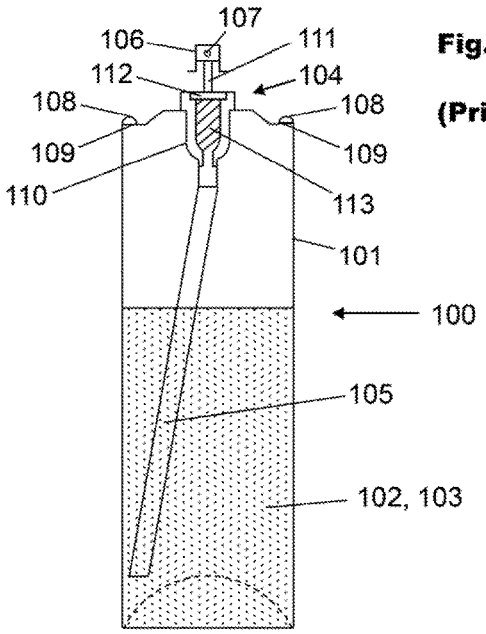
Fig. 1 (Prior Art)
FIG. 1 illustrates schematically a typical aerosol canister.

As illustrated in FIG. 1, aerosol canisters 100 in general comprise several basic components. These components include a can 101, a product 102, a propellant 103, a valve 104 with dip tube 105, and an actuator 106 with nozzle 107. Most canisters also comprise a dust cap (not shown) to prevent the nozzle 107 of the actuator 106 from becoming blocked with dust particles.

The product 102 (e.g. hair spray, insect repellent etc) is typically in liquid form. Legislation governs the amount of product 102 that may be contained, and for safety reasons, there is always space in the can that does not contain liquid. Once the product 102 has been added, the aerosol valve 104 is fitted (crimped) to the top of the can 101 to provide a fluid tight seal. The internal pressure which is used to force the product 102 from the canister is provided by the propellant 103. The propellant 103 may be a liquefied gas or a compressed gas, and is added to the can 101 by injection through the valve 104. In FIG. 1, the propellant 103 is shown as a liquefied gas mixed together with a liquid product 102. The actuator 106 is fitted to the valve 104 after injection of the propellant 103 to facilitate operation of the canister.

A typical aerosol valve 104 comprises several components. These include a cup 108, an outer gasket 109, a housing 110, a stem 111, an inner gasket 112, a spring 113, and the dip tube 105. The cup 108 attaches the valve 104 to the can 101, and the outer gasket 109 forms a seal. The housing 110 contains the inner gasket 112 and spring 113. The stem 111 serves as a tap through which the fluid (product 108 and propellant 109) can flow, whilst the inner gasket 112 covers the hole in the stem 111, and the spring 113 enables depression of the actuator 106. The dip tube 105 directs the fluid from the can 101 to the valve 104.

When the actuator 106 is in the raised position, the hole in the stem 111 is covered by the inner gasket 112 and the fluid is contained within the canister. When the actuator 106 is depressed, however, it pushes the stem 111 through the inner gasket 112, and the hole is uncovered, allowing fluid to pass through the valve 104 and into the actuator 106. The valve 104 and the actuator 106 are important components in the aerosol canister. They both contain small holes and channels which control the flow rate of the fluid, as well as the characteristics of the spray that emerges from the actuator 106.

As mentioned in the background section, existing techniques for venting aerosol canisters have the disadvantages of restricting the actuator design, or requiring specialised heavy duty equipment. There will now be described an alternative apparatus and associated methods that may overcome one or more of these issues.

Figure 2:
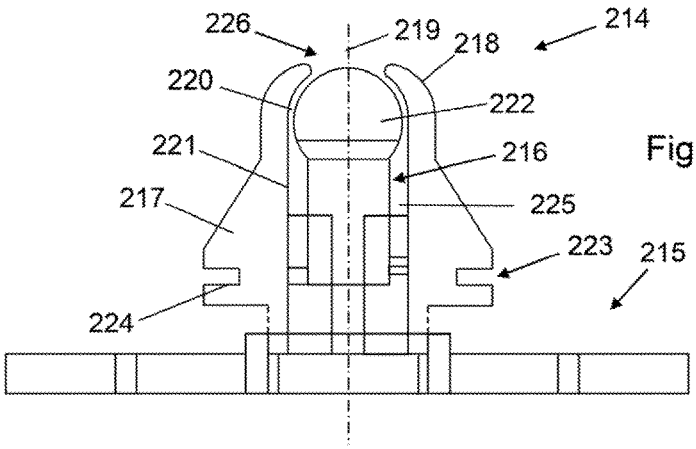
FIG. 2 illustrates schematically a manually-operable vent assembly in cross-section.

FIG. 2 illustrates schematically, in cross-section, a manually-operable vent assembly. Rather than evacuating the product and propellant via the valve (and actuator) or a hole through the side of the can, the present vent assembly uses the base of the can as an evacuation route. Specifically, the vent assembly is located in a hole provided in the base of the can.

The vent assembly 214 comprises first 215 and second 216 members and a receiving part 217 (317). The receiving part 217 has an outer surface 218 which comprises a recess 223. The recess 223 is configured to receive the edges of the hole in the base of the can 101 to form a fluid-tight seal. This allows the vent assembly 214 to be securely fitted to the canister 100. In addition, the external surface 224 of the recess 223 may comprise a resilient material (such as a thermoplastic polymeric material) to help form a fluid-tight seal between the base of the can 101 and the receiving part 217.

The receiving part 217 may also be formed from a resilient material (such as a thermoplastic polymeric material). Additionally, or alternatively, the vent assembly may comprise a gasket between the receiving part 217 and the edges of the hole. Both options may be used to provide a fluid-tight seal between the receiving part 217 and the can 101.

The receiving part 217 further comprises an internal volume 225 having a longitudinal axis 219. The second member 216 is disposed within the internal volume 225 and is configured for linear translation along the longitudinal axis 219 relative to the receiving part 217. The first member 215 is rotatably engaged with the second member 216. Rotation of the first member 215 relative to the second member 216 is configured to impart translation of the second member 216 along the longitudinal axis 219 between first and second positions. In the first position, the second member 216 forms a fluid-tight seal against the receiving part 217, and in the second position, a fluid passage 220 is formed between the second member 216 and an inner surface 221 of the receiving part 217. The second member 216 may be formed from a resilient material such as thermoplastic polymeric material. Additionally, or alternatively, the second member may comprise a gasket 222 (322) between the second member 216 and the inner surface 221 of the receiving part 217. Both options may be used to provide a fluid-tight seal between the second member 216 and an open end 226 of the receiving part 217 when the second member 216 is in the first position.

Figure 3:
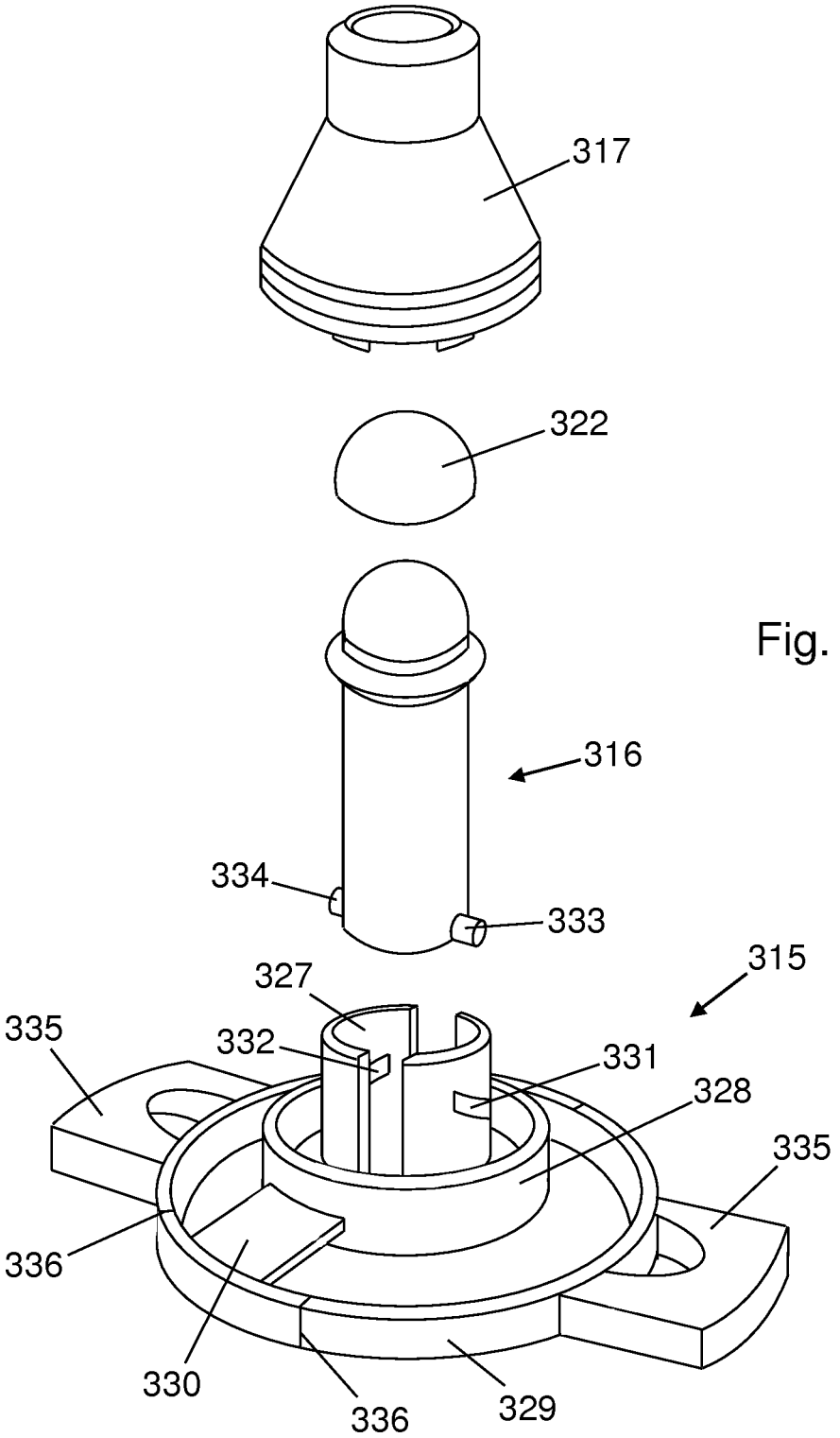
FIG. 3 illustrates schematically an exploded view of the vent assembly.

In one embodiment, as illustrated in FIG. 3, the first member 315 comprises a tubular portion 327, an inner circular portion 328, and an outer circular portion 329. The tubular portion 327 is connected to the inner circular portion 328 by at least one connecting portion (not shown). Likewise, the inner circular portion 328 is connected to the outer circular portion 329 by at least one connecting portion 330. Preferably, these connections 330 are integrally moulded with the tubular 327, inner circular 328 and outer circular portions 329 to form a single unit.

The second member 316 may be engaged with the first member 315 via a cam mechanism. This may be achieved by forming helical slots 331, 332 in the tubular portion 327, and corresponding cam profiles 333, 334 on the second member 316. Alternatively, the tubular portion 327 may comprise the cam profiles 333, 334 and the second member 316 the helical slots 331, 332. In the illustrated embodiment, first 331 and second 332 helical slots are formed on opposite sides of the tubular portion 327, and first 333 and second 334 corresponding cams are provided on the second member 316. The cams 333, 334 may be spring mounted to facilitate insertion of the second member 316 into the tubular portion 327. Alternatively, the tubular portion 327 may be sufficiently resiliently flexible to allow the cam profiles 333, 334 to engage with the corresponding slots 331, 332 by flexing outwards as the second member 316 is inserted.

In another embodiment, the tubular portion 327 may be inserted into the second member 316. As with the previous embodiment, the cam mechanism may be realised by forming helical slots 331, 332 in the tubular portion 327 or second member 316, and forming corresponding cam profiles 333, 334 on the second member 316 or tubular portion 327, respectively.

Figure 4A:
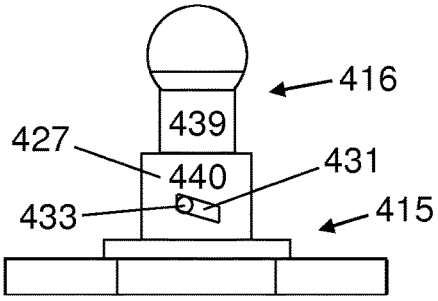
FIG. 4*a* illustrates schematically first and second members of the vent assembly in a first position as seen from the front.
Figure 4B:
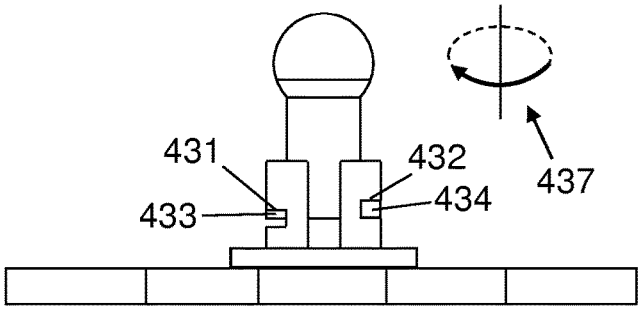
FIG. 4*b* illustrates schematically first and second members of the vent assembly in a first position as seen from the side.
Figure 4C:
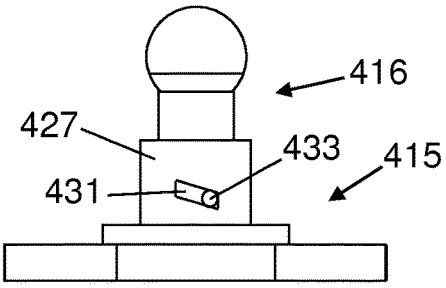
FIG. 4*c* illustrates schematically first and second members of the vent assembly in a second position as seen from the front.
Figure 4D:
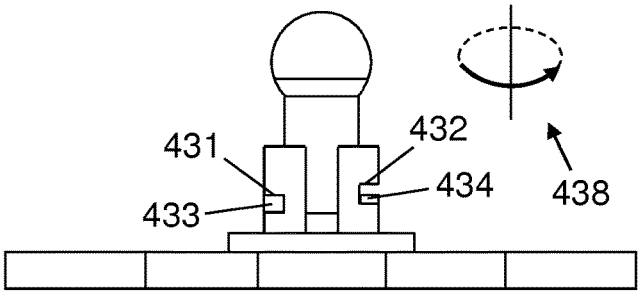
FIG. 4*d* illustrates schematically first and second members of the vent assembly in a second position as seen from the side.

In each of the described embodiments, engagement of the cams 333, 334 with the helical slots 331, 332 causes the second member 316 to be raised or lowered when the first member 315 is rotated. This is illustrated in FIGS. 4*a-d*. In FIGS. 4*a* and 4*b*, the second member 416 can be seen in the first position (i.e. uppermost position). In this configuration, the cams 433, 434 are located at the left hand side of each slot 431, 432. Only the first cam 433 is visible in FIG. 4*a*, whilst both the first 433 and second 434 cams are visible in FIG. 4*b*. When the first member 415 is rotated in a first sense 437, the slot edges guide the cams 433, 434 diagonally downwards, thereby lowering the second member 416. In FIGS. 4*c* and 4*d*, the second member 416 can be seen in the second position (i.e. lowermost position). In this configuration, the cams 433, 434 are located at the right hand side of each slot 431, 432. Only the first cam 433 is visible in FIG. 4*c*, whilst both the first 433 and second 434 cams are visible in FIG. 4*d*. Subsequent rotation of the first member 415 in a second opposite sense 438 then raises the second member 416 from the second position back to the first position.

Although a cam mechanism has been described, alternative mechanisms could be used to rotatably engage the first 415 and second 416 members. For example, where the second member 416 is inserted into the tubular portion 427 (as opposed to the tubular portion 427 being inserted into the second member 416), the external surface 439 of the second member 416 may comprise a screw thread which interacts with a corresponding screw thread on the internal surface of the tubular portion 427. Similarly, where the tubular portion 427 is inserted into the second member 416, a screw thread on the external surface 440 of the tubular portion 427 may interact with a corresponding screw thread on the internal surface of the second member 416.

Figure 5A:
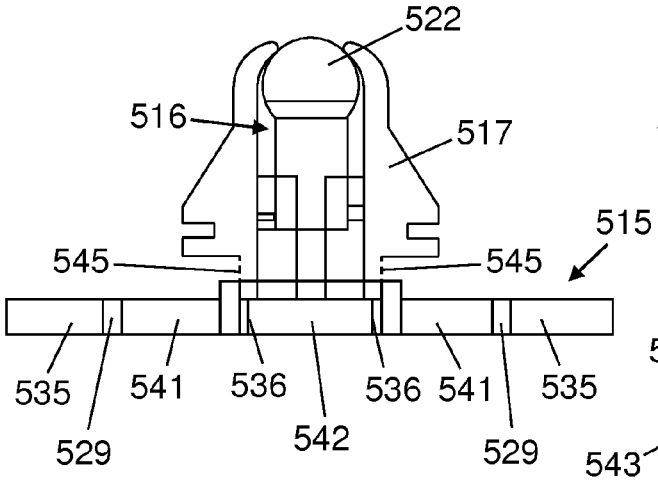
FIG. 5*a* illustrates schematically the vent assembly in a first position.
Figure 5B:
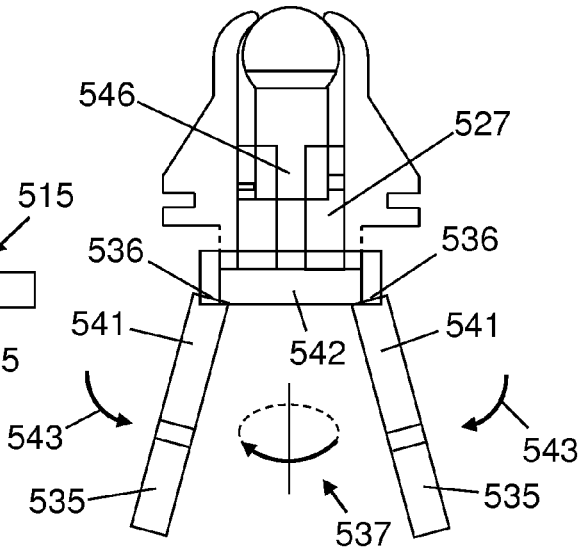
FIG. 5*b* illustrates schematically the vent assembly with the handles in a folded position.

FIGS. 5*a-d* show the relative positions of the second member 516 and receiving part 517 as the first member 515 is rotated. In FIG. 5*a*, the second member 516 is in the first position (i.e. uppermost position). In this configuration, the gasket 522 forms a fluid-tight seal between the second member 516 and the receiving part 517.

The first member 515 further comprises at least one handle 535. Preferably two handles 535 (335) are provided on opposite sides of the first member 515 as shown. The handles 535 are attached to the outer circular portion 529 (329), and provide points of contact between the user and the vent assembly. Furthermore, the outer circular portion 529 is split into three sections—two end sections 541 and a middle section 542. The end sections 541 are connected to the middle section 542 by hinges 536 (336). These hinged connections 536 allow the two end sections 541 to be folded towards one another (FIG. 5*b*) when the user pulls on the handles 535, as indicated by the arrows 543.

Figure 5C:
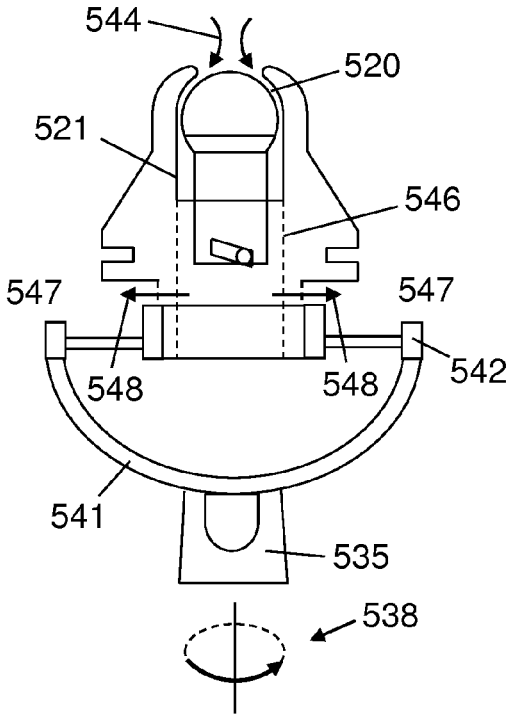
FIG. 5*c* illustrates schematically the vent assembly in a second position after turning the folded handles clockwise.

The base 649 of the can may comprise one or more protruding elements 650 (FIG. 6) which engage with the handles 535 to prevent rotation of the first member 515 whilst the handles 535 are in the horizontal position. In order to avoid contact with the protruding elements 650, therefore, the handles 535/end sections 541 need to be in the folded position. Once the handles 535/end sections 541 are in the folded position, the user is able to rotate the first member 515. As previously described, rotation in a first sense 537 lowers the second member 516 from the first position to the second position (FIG. 5*c*). Lowering of the second member 516 forms a fluid passage 520 between the second member 516 and the inner surface 521 of the receiving part 517. Formation of the fluid passage 520 allows fluid (product and/or propellant) to pass from the canister to the fluid passage 520 (as indicated by the arrows 544).

The receiving part 517 further comprises at least one opening 545. Preferably two openings 545 are provided on opposite sides of the receiving part 517 as shown. In addition, the tubular portion 527 also comprises at least one opening 546 (two openings 546 are shown). When the second member 516 is in the second position (i.e. lowermost position), the openings 546 of the tubular portion 527 are aligned with the openings 545 of the receiving part 517. Alignment of the openings 545, 546 facilitates the flow of fluid from the fluid passage 520 to the outside 547 of the canister via the openings 545, 546 (as indicated by the arrows 548). The openings 545, 546 of the receiving part 517 and tubular portion 527 are configured such that the fluid is able to pass through the openings 545, 546 in a direction substantially perpendicular to the longitudinal axis 519.

By allowing the end sections 541 of the outer circular portion 529 to be folded towards one another, the user can rotate the first member 515 using the handles 535 without coming into direct physical contact with the fluid as it passes from the fluid passage 520 to the outside 547 of the canister. This feature is particularly advantageous when the product or propellant is hazardous.

Figure 5D:
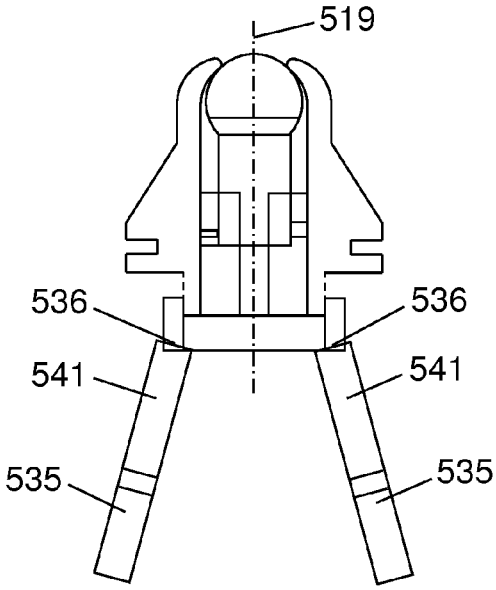
FIG. 5*d* illustrates schematically the vent assembly returned to the first position after turning the folded handles anti-clockwise.
Figure 7:
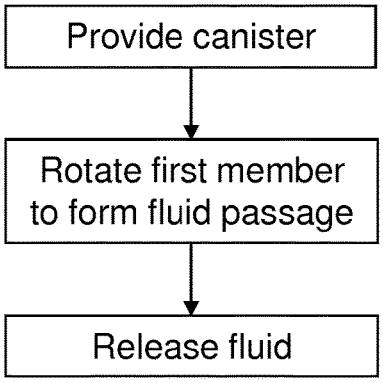
FIG. 7 illustrates schematically a method of venting a canister.

Once venting is complete, the first member 515 may be rotated in a second opposite sense 538 to raise the second member 516 from the second position to the first position so that the gasket 522 can form a fluid-tight seal between the second member 516 and receiving part 517 (FIG. 5*d*). When the seal is formed, the handles 535/end sections 541 can then be folded back to their original horizontal positions. The key steps of the method used to vent the canister are illustrated schematically in FIG. 7.

Figure 6:
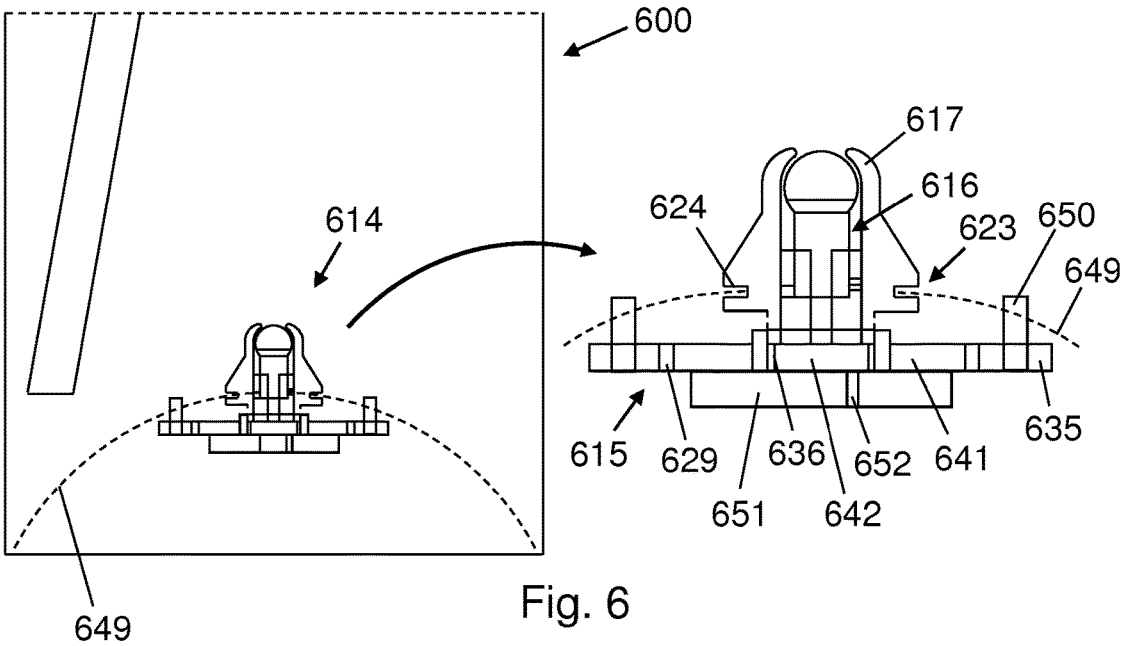
FIG. 6 illustrates schematically an aerosol canister comprising the vent assembly.

FIG. 6 shows an aerosol canister 600 comprising the vent assembly 614 described herein. As described previously, the receiving part 617 includes a recess 623 configured to receive the edges of the hole in the base 649 of the can. This allows the vent assembly 614 to be securely fitted to the canister 600. In addition, the external surface 624 of the recess 623 may comprise a resilient material to help form a fluid-tight seal between the base 649 of the can and the receiving part 617.

The vent assembly 614 may further comprise a removable seal 651 configured to prevent rotation of the first member 615 without the seal 651 having first been removed. This feature could serve as a child-lock to prevent children from venting the canister 600, may prevent against accidental venting of the canister 600, and may also be used to determine whether or not the valve assembly 614 has been tampered with. The removable seal 651 is attached to the end sections 641 and middle section 642 of the outer circular portion 629 overlapping the hinges 636. The removable seal 651 prevents the handles 635/end sections 641 from being pulled into the folded position. As discussed previously, the handles 635/end sections 641 need to be in the folded position in order to avoid contact between the handles 635 and the protruding elements 650 at the base 649 of the can. The removable seal 651 may be integrally moulded with the outer circular portion 629 in such a way that the seal 651 can be peeled or snapped off by pulling on a tab 652.

Other embodiments depicted in the figures have been provided with reference numerals that correspond to similar features of earlier described embodiments. For example, feature number 1 can also correspond to numbers 101, 201, 301 etc. These numbered features may appear in the figures but may not have been directly referred to within the description of these particular embodiments. These have still been provided in the figures to aid understanding of the further embodiments, particularly in relation to the features of similar earlier described embodiments.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

While there have been shown and described and pointed out fundamental novel features as applied to different embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A method for releasing residual pressurised fluid from an aerosol canister, said method comprising the manual opening of a vent assembly for said canister, the vent assembly comprising first and second members and a receiving part, the receiving part having an outer surface configured to form a fluid seal against an edge of a hole in the canister, and an internal volume having a longitudinal axis, the second member disposed within the internal volume of the receiving part and configured for linear translation along the longitudinal axis relative to the receiving part, the first member rotatably engaged with the second member, rotation of the first member relative to the second member configured to impart translation of the second member along the longitudinal axis such that, in a first position, the second member forms a fluid seal against the receiving part and, in a second position, a fluid passage is formed between the second member and an inner surface of the receiving part.

2. A method according to claim 1, wherein the first and second members are rotatably engaged by a cam mechanism, the cam mechanism comprising a helical slot and a corresponding cam.

3. A method according to claim 2, wherein the first member comprises the helical slot and the second member comprises the corresponding cam.

4. A method according to claim 2, wherein the second member comprises the helical slot and the first member comprises the corresponding cam.

5. A method according to claim 1, wherein the second member comprises a gasket, the gasket configured to provide a fluid-tight seal between the second member and the receiving part when the second member is in the first position.

6. A method according to of claim 1, wherein the receiving part comprises an opening configured to allow the fluid to pass from the fluid passage to the outside of the canister in a direction substantially perpendicular to the longitudinal axis.

7. A method according to claim 6, wherein the first member comprises a handle extending laterally outwards from the first member.

8. A method according to claim 7 wherein the handle is connected to the first member by a hinged connection configured to allow the handle to be operated from a first position to a second hinged position.

9. A method according to claim 8, wherein the canister comprises a protruding element configured to engage with the handle when the handle is in the first position to prevent rotation of the first member.

10. A method according to claim 8, wherein the vent assembly comprises a removable seal attached to the first member, the removable seal configured to prevent movement of the handle from the first position.

* * * * *